US006151736A

United States Patent [19]

Samuels

[11] Patent Number: 6,151,736

[45] Date of Patent: Nov. 28, 2000

[54] UTILITY SEAT

[76] Inventor: Byron Y. Samuels, 924 Virginia Ave., Virginia Beach, Va. 23451

[21] Appl. No.: 09/326,632

[22] Filed: Jun. 7, 1999

Related U.S. Application Data

[60] Provisional application No. 60/088,547, Jun. 9, 1998.

[51] Int. Cl.[7] ..... A47C 27/00; A47C 16/00

[52] U.S. Cl. ..... 5/653; 5/656; 5/948; 428/76; 428/476.1; 428/476.3

[58] Field of Search ..... 5/653, 417, 420, 5/484, 500, 502, 690, 656, 948; 428/76, 102, 220, 476.1, 476.3

[56] References Cited

U.S. PATENT DOCUMENTS

| | | | |
|---|---|---|---|
| 2,351,767 | 6/1944 | Johnson | 5/484 |
| 4,499,131 | 2/1985 | Knox | 5/502 |
| 4,846,822 | 7/1989 | Foxman | 5/484 |
| 5,386,603 | 2/1995 | Drust | 5/484 |
| 5,572,758 | 11/1996 | Merritt | 5/653 |

*Primary Examiner*—Alexander Grosz
*Attorney, Agent, or Firm*—Miles & Stockbridge P.C.; Edward J. Kondracki

[57] ABSTRACT

A multi-purpose utility seat for use at outdoor events includes a three layer laminate structure comprising outer layers of nylon and a center water impermeable rubber layer which may be either chloroprene rubber (neoprene) or styrene butadiene rubber. The thickness of the laminate is approximately 80 mils with the center layer being substantially thicker than either of the outer layers. The perimeter of the seat is or closed with stitching to help prevent separation of the laminate. The seat may be conveniently folded and stored in the glove compartment of an automobile when not in use.

10 Claims, 1 Drawing Sheet

UTILITY SEAT

This application is directed to an invention that has been described and depicted in U.S. Provisional Application Serial No. 60/088,547, filed Jun. 9, 1998.

FIELD OF THE INVENTION

This invention relates to a multi-purpose utility seat useful for the protection of clothing and keeping the body warm when sitting on damp surfaces and/or protection of car seats from wet bathing suits.

BACKGROUND OF THE INVENTION

Frequently, when participating in outdoor activities and attending outdoor events, participants are subject to conditions which make seating uncomfortable because of wetness and cold being transmitted to the body parts. For example, at outdoor theaters where lawn seating is available, the lawn may be damp from prior rain or dew. To protect ones clothing and underside against dampness and cold, resort is often made to the use of blankets, papers or sheets of plastic materials. However, within a short time, such fabric materials lose their effectiveness and eventually offer little protection against the dampness and the cold, and fail to provide the protection and comfort for which they were intended.

Another example where there is need for protection of clothing and the body is at outdoor sporting events where seating is on cement steps or metallic steps or chairs. Unless such seating is under protective cover, this seating subject to becoming wet from rain or other elements. Because such seating is hard and unyielding, and a good transmitter of cold, resort is often made to portable padded seating, which often include back supports. Such seating has limited application or use, is relatively expensive to produce. Because of its bulkiness, it takes up considerable room and cannot be stored in a small compartment such as a vehicle glove box or compartment.

The aforenoted disadvantages of known utility seats are overcome by the present invention which provides a multi-purpose utility outdoor car seat which protects against dampness, adds comfort due to padding and which can be economically made so as to make it suitable for use a promotional give away. Such a utility seat has many advantages.

One advantage of the present invention is to provide an all-purpose seat which can be used to protect a car seat from a wet bathing suit after the user has engaged in water activities.

Another object of the present invention is to provide an multi-purpose seat which insulates a user from heat or cold and provides padding and comfort when sifting on hard unyielding surfaces.

Still another object of the present invention is to provide an multi-purpose seat which is readily foldable into a compact package that can be conveniently and unobtrusively carried or stored in a limited access area such as the glove compartment of an automobile.

Yet another object of the present invention is to provide an multi-purpose seat which is economical to manufacture and is readily adapted for use as a promotional item.

BRIEF DESCRIPTION OF THE DRAWINGS

These and other objects of the invention and their attendant advantages will be readily apparent to those skilled in the art from the following drawings, when considered in connection with the description of the preferred embodiments. In the drawings, like parts in that several views are identified with like reference characters.

DESCRIPTION OF THE PREFERRED EMBODIMENTS

Figure 1:
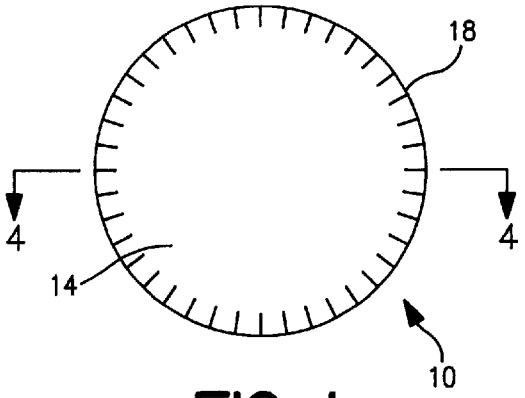
FIG. 1 is a diagrammatic representation of the multi-purpose seat of the present invention in circular form.
Figure 3:
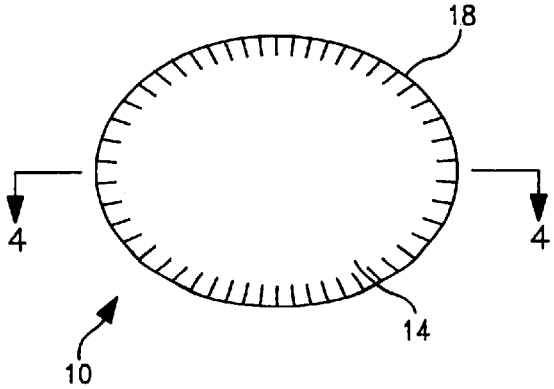
FIG. 3 is a diagrammatic representation of the present invention in oval form.

Referring now to FIGS. 1 and 3, there are illustrated three different forms of the invention. FIG. 1 illustrates a seat 10 which is circular in shape, having a preferred diameter of 19 inches. Generally, the diameter will be between 18 and 20 inches, but the size could vary to 15 to 23 inches. Below 15 inches, the seat begins to lose its capability of providing adequate padding for comfort and protection against wetness and cold because it is to small to adequately cover the body parts. Above twenty-three inches in diameter, the seat becomes cumbersome to handle and use, particularly if it used at a location such as a stadium where each assigned seat has a limited length and width.

Figure 2:
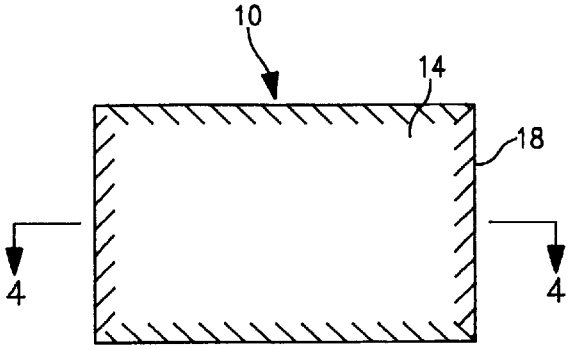
FIG. 2 is a diagrammatic representation of the present invention in rectangular form.

Because conventional outdoor seating for sporting events are generally rectangular in shape, a preferred form of utility seat 10 for such applications is the rectangular shape of FIG. 2. The rectangular seat has a preferred length between 15 and 23 inches and a preferred width of approximately 16 inches. The preferred longitudinal mention of the rectangular multi-purpose seat is 18 or 19 inches with a preferred width of 16 inches.

The oval shape utility seat shown in FIG. 3 is preferably used with wide chair applications, such as automobile seats; where it is desired to limit forward length because the legs are maintained at right angles to the seat; it should be readily apparent that none of the seats of FIGS. 1–3 are restricted in application because each include the desired attributes of thinness, foldability and resistance to moisture and cold.

Figure 4:
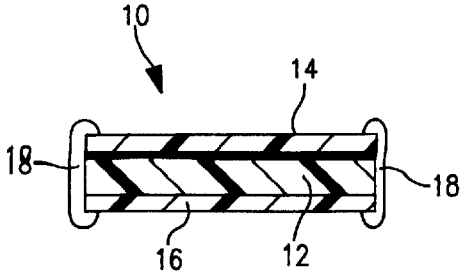
FIG. 4 is a cross-section of the multi-purpose car seat taken across lines 4—4 of FIGS. 1, 2, and 3.

Referring now to FIG. 4, it will be seen that each of the seats of FIGS. 1–3*a*, other than in shape, of like construction and comprises a three layer laminate including a center water impervious layer 12, the opposite faces of which are laminated to outer thin layers 14 and 16. Preferably, the inner layer 12 is chloroprene rubber (neoprene), while the outer layers are nylon. As an alternative for inner layer 12, a styrene butadiene rubber layer may be utilized.

The center layer 12 is substantially thicker then that of the laminated outer layers 12 and 14. Advantageously, the layer 12 is about 2–4 times the thickness of the outer nylon layers 14 and 16. The dimensions shown in FIG. 4 are exaggerated for clarity of illustration. The total thickness of the seat is approximately 80 mils. The thickness of the neoprene layer is approximately 40 mils, and the thickness of the outer layers is approximately 20 mils. It should be readily apparent that the dimensions are approximate and can vary slightly upwards and downwards so long as the final product is lightweight and foldable, so that the seat can be readily folded into a compact package when not in use.

The outer perimeter of the laminate is surged or closed with suitable stitching as at 18 to minimize unraveling or separation.

It should be readily apparent that the utility seat lends itself readily for use as a promotional item because of its relative simplicity and low manufacturing costs. To this end, a team logo or any suitable advertising logo may be imprinted on the outer surface opposite outer layers 14 and 16. Also, layers 14 and 16 may be made in different colors to represent team colors. The seat can be conveniently stored in the glove compartment of an automobile and carried to a sporting or other outdoor event. For example, with a rectangular utility seat which is 16×18 inches folded upon itself twice, the result is a small package 8×9 inches with an overall thickness of approximately 320 mil or less than ½ inch.

In the case of the circular utility seat, the seat 10 is first folded in half and then in half again to provide a quarter arc segment at which point the fabric can be conveniently rolled along one radius to form a cone shaped element which can conveniently be held together by a rubber band or string and put away for safekeeping in the glove compartment of a car. The overall length of the folded seat is the radius of the radial of the circular member, while the width varies from a point at one end to about a circle at the other end having a diameter of about 1280 mils or about 1¼ inches.

While preferred forms and embodiments of the invention have been illustrated and described, it will be apparent to those of ordinary skill in the art that various changes and modifications may be made without deviating from the inventive concept and the true spirit of the invention as set forth above, and it is intended by the appended claims to define all such concepts which come within the full scope and true spirit of the invention.

What is claimed is:

1. A multi-purpose foldable utility seat having a thickness of approximately 80 miles and, having a laminated structure comprising a center layer and first and second adjacent outer layers, said center layer comprising a water impermeable rubber material comprising styrene butadiene rubber or chloroprene rubber, and said outer layers comprising nylon, and stitching means along the perimeter for preventing separation of the layers at the edges.

2. The multi-purpose utility seat of claim 1, wherein the seat is circular.

3. The multi-purpose utility seat of claim 2, wherein the center layer is substantially thicker than either of the outer layer.

4. The multi-purpose utility seat of claim 3, wherein the laminate may be roll folded to provide a package suitable for storage in the glove compartment of a motor vehicle.

5. The multi-purpose utility seat of claim 1, wherein the center layer is substantially thicker than either of the outer layers.

6. The multi-purpose utility seat of claim 1, wherein the shape of the seat is rectangular.

7. The multi-purpose utility seat of claim 6, wherein the laminate may be folded upon itself at least twice to provide a relatively small compound package suitable for storage in the glove compartment of an automobile.

8. The multi-purpose seat of claim 6, wherein the center layer is substantially thicker than either of the outer layers.

9. The multi-purpose utility seat of claim 1, wherein the shape of the seat is oval.

10. The multi-purpose utility seat of claim 9, wherein the center layer is substantially thicker than either of the outer layers.

* * * * *

UNITED STATES PATENT AND TRADEMARK OFFICE

CERTIFICATE OF CORRECTION

PATENT NO. : 6,151,736
DATED : Nov. 28, 2000
INVENTOR(S) : Samuels

It is certified that error appears in the above-identified patent and that said Letters Patent is hereby corrected as shown below:

IN THE CLAIMS:

Claim 1, line 2, change "miles" to "mils"

Signed and Sealed this

Eighth Day of May, 2001

*Attest:*

Nicholas P. Godici

NICHOLAS P. GODICI

*Attesting Officer*

*Acting Director of the United States Patent and Trademark Office*